US006832569B2

(12) United States Patent
Krasnitz

(10) Patent No.: US 6,832,569 B2
(45) Date of Patent: Dec. 21, 2004

(54) COMBINED SCREENPRINT AND EMBROIDERING METHOD AND APPARATUS

(75) Inventor: Ronald H. Krasnitz, Setauket, NY (US)

(73) Assignee: Tajima USA, Inc., Ronkonkoma, NY (US)

( * ) Notice: Subject to any disclaimer, the term of this patent is extended or adjusted under 35 U.S.C. 154(b) by 0 days.

(21) Appl. No.: 10/736,767

(22) Filed: Dec. 16, 2003

(65) Prior Publication Data

US 2004/0154512 A1 Aug. 12, 2004

Related U.S. Application Data

(60) Provisional application No. 60/433,833, filed on Dec. 16, 2002, and provisional application No. 60/454,807, filed on Mar. 14, 2003.

(51) Int. Cl.[7] ..... D05C 9/04; B05C 17/08; B41F 15/18

(52) U.S. Cl. ..... 112/475.18; 112/103; 101/127.1

(58) Field of Search ..... 112/475.18, 475.21, 112/103, 119, 78, 439; 101/127, 127.1, 128, 128.1; 2/244, 246; 38/102.91, 102.2; 33/11, 17 R, 614

(56) References Cited

U.S. PATENT DOCUMENTS

| | | | | |
|---|---|---|---|---|
| 4,315,461 A | | 2/1982 | Harpold | |
| 4,972,773 A | * | 11/1990 | Barlow | 101/127.1 |
| 5,005,219 A | * | 4/1991 | Diaz | 2/244 |
| 5,144,899 A | | 9/1992 | Allen | |
| 5,372,506 A | * | 12/1994 | Hambright | 434/84 |
| 5,546,877 A | | 8/1996 | Moore | |
| 5,953,987 A | * | 9/1999 | Oleson | 101/127.1 |
| 6,051,090 A | | 4/2000 | Healy et al. | |
| 6,067,737 A | * | 5/2000 | Guenther | 38/102.2 |
| 6,390,001 B1 | * | 5/2002 | Jones | 112/470.15 |
| 6,640,735 B2 | * | 11/2003 | Kwang | 112/475.18 |
| 6,679,190 B1 | * | 1/2004 | French et al. | 112/103 |

FOREIGN PATENT DOCUMENTS

JP 2512186 5/1991

OTHER PUBLICATIONS

Melco Industries, Inc. "Patch Hoop User's Manual", dated Aug. 1, 1984, Denver, Colorado.

DVD containing a copy of a video produced in Jan., 1994 showing a demonstration for using adhesives and clear backing materials for an embroidering process, Tajima Industries, Ltd., Japan.

* cited by examiner

*Primary Examiner*—Ismael Izaguirre
(74) *Attorney, Agent, or Firm*—Ostrager Chong Flaherty & Broitman PC

(57) ABSTRACT

An apparatus and method for supporting and transferring a material between a screenprint machine and an embroidery machine without having to remove the material before the designs are complete. The apparatus and method maintain the alignment of the area on the material to be embellished with the designs in both machines, thus providing a properly registered design including both screenprinting and embroidery.

21 Claims, 3 Drawing Sheets

40
42
18
10
14
20
20
18
16
44
30
32
46
48
28
12

FIG. 4
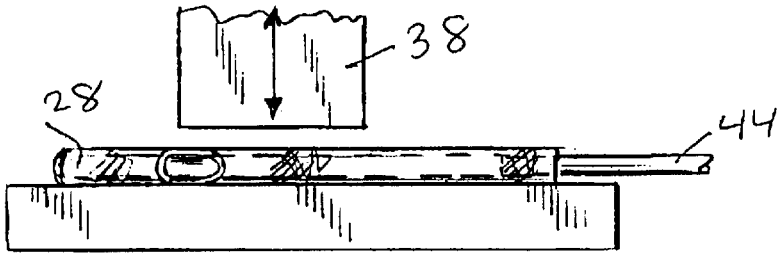
FIG. 5
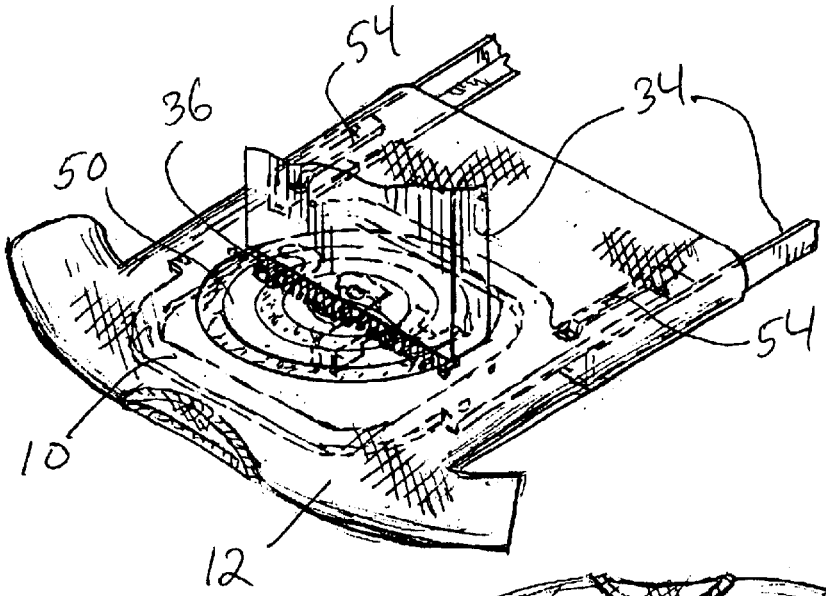
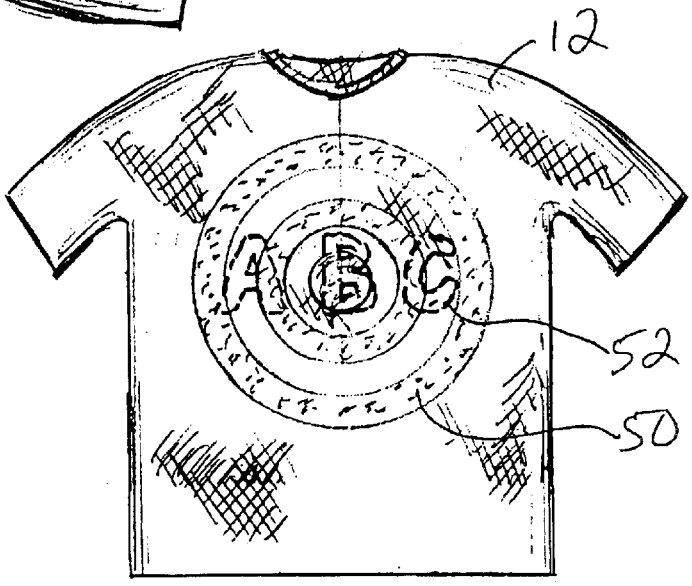
FIG. 6

COMBINED SCREENPRINT AND EMBROIDERING METHOD AND APPARATUS

CROSS REFERENCE TO RELATED APPLICATIONS

This application claims the benefit of U.S. Provisional Patent Application Nos. 60/454,807 filed Mar. 14, 2003 and 60/433,833 filed Dec. 16, 2002, both of which are incorporated herein by reference.

FIELD OF INVENTION

This invention generally relates to a method for accurately transferring a material between a screenprint machine and an embroidering machine, such that a design or other marking to be made on the material may be properly registered and aligned on both machines, and to an apparatus for holding the material during both embroidering and screenprinting methods without removing the material from the apparatus.

BACKGROUND OF INVENTION

It is quite common for many types of materials that are used for various applications (for example, clothing, towels, napkins, bags and caps) to be embellished with designs or other markings. Such designs and markings may be added to the material by several methods or combinations of methods, including screenprinting and embroidering.

Typical screenprinting methods provide a flat board or platen on which the material is laid down. A spray adhesive is often used to secure the material to the platen to ensure that the material remains flat against the platen during the screenprinting process. A screen containing a desired pattern or design is then laid flat onto the material and ink is applied by squeegee or other means. Subsequent screens may be used to apply different colors or designs to the material. When the design is completed and the screens are removed, the printed material may be dried in an oven depending on the type of ink used. Additional heating steps may be used after each screen is printed. When screenprinting is completed, the material is peeled off of the platen, which must be done carefully to avoid stretching the design on the material.

Embroidering methods require that the material be held in an embroidering machine in a particular position. Thus, the material must be attached to a holding device (often called a "hoop" or a "frame") before insertion into the embroidering machine or to a holding device that is part of the embroidering machine. The holding device typically includes a plastic, wood, or metal peripheral frame, which forms a border around an aperture where the stitching or embroidering operations occur. The material must be attached to the holding device in a tensioned or taut state to permit the embroidered patterns to be consistently and accurately produced. Typical attachment means consist of mechanical or adhesive means, and may include the use of a backing material that provides further support to the material to be embroidered in the areas furthest from the holding device, such as the central area. The stitching operation is then performed while controllably moving the holding device relative to a stitching needle to produce a desired stitching pattern.

When a material is embellished with designs or markings using both embroidery and screenprinting, the material is typically screenprinted first. The printed material is then removed from the screenprinting platen, dried, inserted into a hoop and the hoop is then installed into the embroidery machine. It has been found that completing this process has several disadvantages. For example, the design on the material may be distorted due to stretching of the material when removing the printed material from the screenprinting machine or when the material is stretched for insertion into a hoop. Further, it is difficult to maintain the proper registration between the embroidery and screenprint designs, in part, because the material is not aligned in the same position in both the screenprint and embroidery machines. Various methods of overcoming these problems have been attempted, but are time consuming and may not be accurate. Further, current embroidery hoops may not be used in screenprint machines because the hoops do not lay flush on the screenprint platens.

SUMMARY OF THE INVENTION

The present invention seeks to overcome these problems by providing a method and apparatus for securing a material in both an embroidery machine and a screenprinting machine without having to remove the material from its securement before both processes are completed.

The method comprises the steps of registering a support frame for proper alignment in an embroidering machine and a screenprinting machine, attaching a backing material to a top surface of the support frame such that it covers a central aperture formed by the support frame, inserting the support frame into a recess formed in a screenprint platen such that the top surface of the support frame is flush with a top surface of the platen and the backing material lays flat on the top surface of the platen, attaching the material to be embellished with a design to a top surface of the backing material, such that an area to be screenprinted is located in the central aperture, screenprinting a design onto the material, removing the support frame from the platen, with the backing material and the material attached, to avoid stretching and/or cracking of the design, and installing the support frame, with the backing material and material attached, onto the embroidering machine such that stitching can be added to the design. The backing material may be attached to the support frame and the material may be attached to the backing material by adhesive. During the screenprinting step, the ink that is printed may be dried between application of different colors or designs, or after the screenprinted design is completed.

The apparatus of the invention comprises a support frame comprising a rigid material arranged to form a central aperture wherein the screenprinting and embroidering occurs, means for installing the support frame onto an embroidering machine, means for aligning the support frame for proper registration of the central area in the embroidering and screenprint machines, and a screenprint platen having a recess formed in a top surface thereof, the recess having a shape that is substantially similar to a shape of the support frame, and a depth sufficient for the top surface of the support frame to be flush with a top surface of the screenprint platen. This enables the support frame to be easily installed and removed from the screenprint platen without having to remove the material having the freshly screenprinted design.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 4 is a side view of the apparatus of FIG. 2 as installed in a screenprint machine.

FIG. 5 is a perspective view of the apparatus as installed in an embroidery machine.

FIG. 6 is a representation of a garment that is embellished with both a screenprinted design and an embroidered stitch design in accordance with the method of the invention.

DETAILED DESCRIPTION OF THE DRAWINGS

Figure 1:
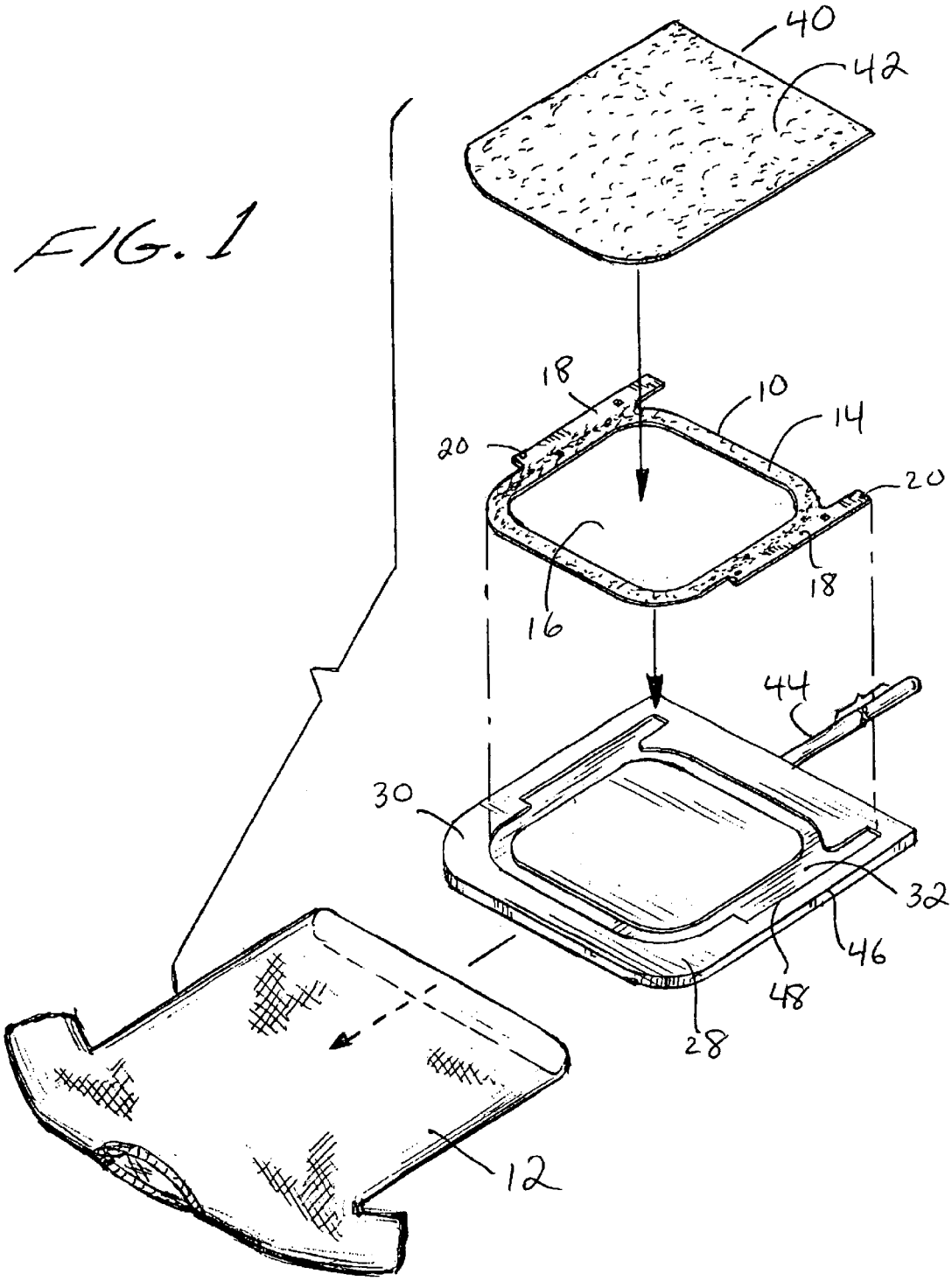
FIG. 1 is an exploded perspective view of one embodiment of the apparatus of the invention as used with a screenprinting machine.

Referring to the drawings, and more particularly to FIG. 1, a support frame 10 is provided for holding a material that is to be embellished with screenprinting and embroidery designs. The material 12 may be any material that can be screenprinted and embroidered, for example, clothing, towels, napkins, bags and caps. A t-shirt 12 is used as a representative example in the drawings. The support frame 10 and the method for using the support frame may be applied to any of the commercially available screenprint and embroidery machines.

The support frame 10 is a one-piece frame having a top surface 14 and a bottom surface (not shown,) and is formed of a thin, rigid material for supporting and transporting the material 12 in and between the screenprint and embroidery machines. The support frame 10 is configured to form a central void 16, where the screenprint and embroidery operations take place. The support frame 10 may be configured in any open geometrical shape, such as a triangle, rectangle or square (with rounded or sharp edges for each), circle or oval. Further, the support frame 10 is made from any material that provides the support necessary for both embroidery and screenprinting, and withstands the temperatures associated with oven drying after the screenprinting process. A preferred material for the support frame is metal, but other heat withstanding material is suitable. The dimensions of the support frame may vary depending on the size of the design to screenprinted or embroidered or the size of the material to be embellished. In the present example, the support frame 10 is substantially square with rounded edges having a length and width of about 11.5 inches and a thickness of approximately ⅛ of an inch, although, as with the basic shape, the length, width and thickness can vary widely depending on the application.

The support frame 10 may further include mounting arms 18 on opposing sides of the support frame for installing the support frame 10 on to an embroidery machine (as shown in FIG. 5). The mounting arms 18 are preferably integrally formed with the support frame and extend parallel to each other away from the support frame 10 and the central void 16. However, the mounting arms 18 may be separate pieces that can be removably attached to the support frame 10. The mounting arms 18 may be used for as explained below. The mounting arms 18 include notches 20 located at a peripheral edge of the arms 18, and a hole 22, which may engage pins on the embroidery machine. Alternatively, apertures 24 may be used for engagement with locking springs 54 for positioning on the embroidery machine 34. The exact location, shape and types of notches and holes, as well as the shape and size of the mounting arms 18, may vary from those depicted in FIG. 1 as necessary to attach the support frame to different model embroidery machines or those from other manufacturers.

The support frame 10 also includes a pair of alignment holes 26 for registering the support frame 10 in the proper location in both the screenprint and embroidery machines. Alternatively, the alignment holes can be replaced with any type of positioning mark, such as etched cross-hairs.

Figure 3:
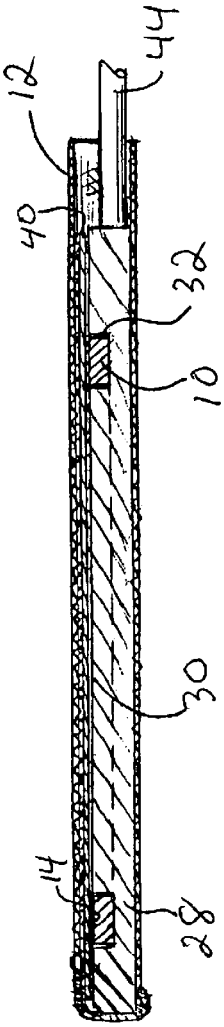
FIG. 3 is a cross-sectional view of the apparatus of FIG. 2, shown along the lines 3—3 of FIG. 2.

A further feature of the invention is to provide a screenprint platen 28 having a top surface 30 with a recessed groove 32 cut therein. The recessed groove 32 has a shape and size that is substantially similar to the shape and size of the support frame 10. This permits the support frame 10 to be inserted into the platen 28 such that the support frame's top surface 14 is flush with the platen's top surface 30 to form a uniform and flat screenprinting surface (as shown in FIG. 3).

Further features of the apparatus will be apparent as the method of the invention is described in more detail. When embellishing a material with both screenprinting and embroidery, it is important that the material be properly aligned in both machines so that the screenprinting and embroidery designs are properly aligned. Thus, the first step in the process should be to properly register or align the support frame 10 in both the screenprint and embroidery machines. This is preferably accomplished by first installing the support frame 10 by itself into both machines. This is a one-time setup that should be completed before any design is applied to the material.

The mounting arms 18 of the support frame 10 may first be aligned with and installed onto corresponding arms on the embroidery machine 34 (see FIG. 5), which have a leaf-spring locking device 54 that engage the apertures 24 on the mounting arms 18. The support frame 10 as installed in the embroidery machine is then moved to the proper location in relation to the stitching needles 36 by lowering one of the needles to one of the alignment holes 26, then shifting the support frame 10 horizontally to align the same needle with the second of the alignment holes 26. If the second alignment hole does not align with the needle, then the mounting arm 18 must be moved in a vertical direction to align the hole below the needle. The support frame 10 may then be removed from the embroidery machine for later use without changing the alignment.

The support frame 10 may then be installed into the recessed groove 32 in the screenprint platen 28. The screenprint machine 38, including the screen, is then brought over the platen 28. Cross-hairs in the screen are then visually aligned with the alignment holes 26 in the support frame 10 by moving the screen in horizontal (left to right) and/or vertical (front to back) directions. The screen and platen 28 are then locked into position.

Typically, when applying both screenprint and embroidery designs to a material, the screenprinting is done first. However, if the embroidery and screenprint designs do not overlap, the embroidery could be done first. The method of the invention will be described with the screenprint operation occurring first.

Referring again to FIG. 1, the support frame 10 may be left in the platen's recessed groove 32 after the registration process, or the support frame may be removed. The top surface 14 of the support frame is covered with an adhesive around the periphery of the frame, and a backing material 40 is adhered to the top surface 14. The adhesive is preferably strong enough such that the backing material may be securely attached to the frame, yet light enough such that the backing material may be removed from the frame without damaging the embellished material. For example, hot melt, spray, or other pressure sensitive adhesives may be used, or double sided adhesive tape may be used. Alternatively, the backing material itself may have an adhesive surface for adhering to the support frame. Preferred backing materials are thin nonwoven materials that provide additional support for a fabric or other material, and are commercially available and commonly used with embroidery machines.

A second adhesive is then applied to the top surface 42 of the backing material 40. The second adhesive should have similar properties to the first adhesive used for adhering the backing material to the support frame 10. A preferred second adhesive is a spray adhesive, or the backing material may be of the type that comes with an adhesive already applied on its surface.

Figure 2:
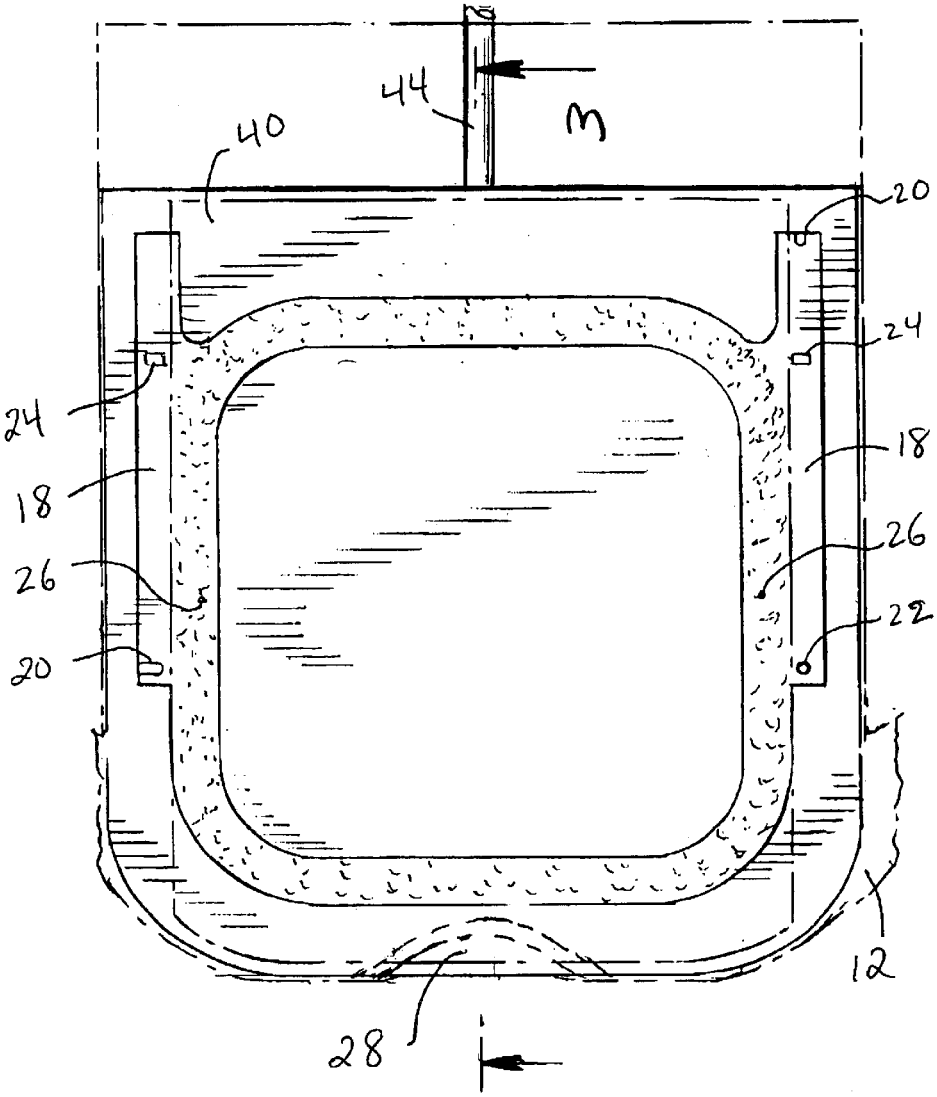
FIG. 2 is a top plan view of the apparatus of FIG. 1, as assembled.

The material to be embellished, for example, a t-shirt 12 is then installed around the combined platen 28, support frame 10 and backing material 40 such that an interior surface of the t-shirt 12 (where the design is to be screenprinted) is adhered to the backing material 40 (as shown in FIG. 2). The remaining portion of the t-shirt wraps around and hangs below the platen 28. Referring to FIG. 3, the top surface 14 of the support frame 10 is flush with the top surface 30 of the platen 28 to form a flat screenprinting surface, and the backing material 40 lies flat against the screenprinting surface, and the t-shirt 12 lies flat against the backing material 40. In the drawings, the platen 28 is shown to have a mounting arm 44. This is illustrative of one way to attach the platen 28 to a screenprinting machine, and is not meant to be limiting. Commercially available screenprinting machines use other attachment means, such as a bracket on the bottom surface of the platen 28, which is attached to a movable arm for positioning the platen in the screenprint machine. The method of this invention may be applied to any commercially available screenprint machine.

A design may then be screenprinted on the t-shirt 12 in accordance with well-known screenprinting techniques, including using multiple screens for different colors or designs. See FIG. 4. If necessary, the ink may be dried between each screen application by applying heat. When the screenprinted design is complete, the support frame 10, including the backing material 40 and the t-shirt 12 are removed from the platen 28 and, if necessary, placed into an oven for drying. Therefore, the support frame 10 must be of a material suitable to withstand elevated temperatures. The platen 28 may be modified to have a further recessed area (not shown) that extends between the outer edge 46 of the platen 28 and the outer edge 48 of the recessed groove 32 to assist with the removal of the support frame 10 from the platen 28.

Once the screenprinted design 50 is dry, the combined structure of the support frame 10, the backing material 40 and the t-shirt 12 may be installed onto the embroidery machine 34, as explained above and shown in FIG. 5. An embroidered design 52 may then be stitched onto the t-shirt 12 either over the screenprinted design 50 or elsewhere on the t-shirt 12, as shown in FIG. 6. When the embroidery is completed, the support frame 10 is removed from t-shirt 12 by peeling the backing material 40 off of the support frame 10. The backing material 40 is then ripped off the interior surface of the t-shirt 12, and the process is complete.

Although the invention has been described with reference to preferred embodiments, it will be appreciated by one of ordinary skill in the art that numerous modifications are possible in light of the above disclosure. For example, the backing material 40 need not be used with certain materials that provide sufficient support, such as vinyl or canvas. In this situation, the material can be attached directly to the support frame 10. All such variations and modifications are intended to be within the scope and spirit of this invention.

I claim:

1. A method for screenprinting and embroidering designs onto a material comprising the steps of:

registering a support frame for proper alignment in an embroidering machine and a screenprinting machine;

inserting the support frame into a recess formed in a screenprint platen such that a top surface of the support frame is flush with a top surface of the screenprint platen;

attaching the material to the top surface of the screenprint platen, such that an area on the material to be screenprinted covers a central aperture formed by the support frame;

screenprinting a design onto the material;

removing the support frame, with the material attached, from the platen; and installing the support frame onto the embroidering machine such that stitching can be added to the design.

2. The method of claim 1, further comprising the step of attaching a backing material to the top surface of the support frame such that the backing material covers the central aperture, and attaching the material to a top surface of the backing material.

3. The method of claim 1, wherein the support frame is registered in the embroidering machine by installing the support frame into the embroidering machine, positioning a first alignment marking on the support frame below a needle of the embroidery machine, moving the support frame horizontally, and aligning a second alignment marking on the support frame below the needle.

4. The method of claim 1, wherein the support frame is registered in the screenprinting machine by lining up alignment markings in the support frame with corresponding markings on the screenprinting machine.

5. The method of claim 2, wherein the backing material is attached to the top surface of the support frame by adhesive means.

6. The method of claim 5, further comprising the step of applying an adhesive to the top surface of the support frame before attaching the backing material.

7. The method claim 6, wherein the adhesive is selected from the group consisting of a hot-melt adhesive, pressure sensitive adhesive, spray adhesive, and double-sided adhesive tape.

8. The method of claim 5, wherein the adhesive means is located on the backing material.

9. The method of claim 2, wherein the backing material is attached to the support frame before inserting the support frame into the recess in the screenprint platen.

10. The method of claim 2, wherein the backing material is attached to the support frame after inserting the support frame into the recess in the screenprint platen.

11. The method of claim 2, wherein the material is attached to the backing material by spray adhesive or by using a backing material having an adhesive surface.

12. The method of claim 1, further comprising the step of drying the design before embroidering.

13. An apparatus for securely holding a material during application of a design by screenprinting and embroidering, comprising:

a support frame comprising a rigid material arranged to form a central aperture wherein the screenprinting and embroidering occurs;

means for installing the support frame onto an embroidering machine;

means for aligning the support frame for proper registration of the central area in the embroidering machine and a screenprinting machine; and a screenprint platen having a recess formed in a top surface thereof, the recess having a shape that is substantially similar to a shape of the support frame, and a depth sufficient for the top surface of the support frame to be flush with a top surface of the screenprint platen.

14. The apparatus of claim 13, further comprising a backing material attached to the top surface of the support frame.

15. The apparatus of claim 13, wherein the screenprint platen comprises a bracket attached to a bottom surface of the platen for installing the platen onto a screenprinting machine.

16. The apparatus of claim 13, wherein the support frame is a thin metal plate.

17. The apparatus of claim 13, wherein the support frame is a geometric shape encompassing the central void, the shape selected from the group consisting of a circle, triangle, square, rectangle or trapezoid.

18. The apparatus of claim 13, wherein the means for installing the support frame onto the embroidery machine comprises a pair of arms extending from opposite sides of the support frame in parallel relationship, the arms having apertures for attachment to leaf springs on the embroidery machine.

19. The apparatus of claim 18, wherein each of the arms further comprises an aperture for engagement with a leaf spring on the embroidery machine.

20. The apparatus of claim 14, further comprising a first adhesive applied on the top surface of the support frame for attaching the backing material to the support frame.

21. The apparatus of claim 20, further comprising a second adhesive for securing the material to the backing material.

* * * * *